US006334256B1

(12) United States Patent
Lüttgens

(10) Patent No.: US 6,334,256 B1
(45) Date of Patent: Jan. 1, 2002

(54) SHARPENER UNIT

(75) Inventor: Fritz Lüttgens, Erlangen (DE)

(73) Assignee: KUM Limited, Dublin (IE)

( * ) Notice: Subject to any disclaimer, the term of this patent is extended or adjusted under 35 U.S.C. 154(b) by 0 days.

(21) Appl. No.: 09/524,507

(22) Filed: Mar. 13, 2000

(30) Foreign Application Priority Data

Mar. 11, 1999 (DE) ..... 199 10 841
Nov. 18, 1999 (DE) ..... 199 55 395

(51) Int. Cl.[7] ..... B43L 23/08
(52) U.S. Cl. ..... 30/454; 30/453
(58) Field of Search ..... 30/452, 453, 454, 30/455, 457

(56) References Cited

U.S. PATENT DOCUMENTS 4,248,283 A 2/1981 Kaye
4,593,468 A 6/1986 Vincent
5,875,555 A * 3/1999 Andrisin et al. ..... 30/454 X

FOREIGN PATENT DOCUMENTS

| | | |
|---|---|---|
| DE | 70 40 342 | 10/1970 |
| DE | 27 45 600 | 4/1979 |
| DE | 81 06 558 | 7/1981 |
| DE | 92 15 257 | 8/1993 |
| EP | 0 596 239 | 5/1994 |

* cited by examiner

*Primary Examiner*—Douglas D. Watts
(74) *Attorney, Agent, or Firm*—Venable; Gabor J. Kelemen

(57) ABSTRACT

The sharpener units includes a pencil or core sharpener and a cover housing, which surrounds and secures the sharpener and comprises a floor part and a hood that is detachably secured thereto. A throughgoing opening is also provided for guiding a pencil or core from the outside into the pencil or core sharpener. The floor and hood parts of the cover housing include fixing elements for selectively securing sharpeners having different external dimensions or formats.

14 Claims, 4 Drawing Sheets

SHARPENER UNIT

BACKGROUND OF THE INVENTION

The invention relates to a so-called container sharpener having a pencil or core sharpener and a cover housing that surrounds the sharpener and catches shavings, the housing including a floor part and a closing hood that can be detachably secured thereto.

In container sharpeners of this type, the detachable hood serves to catch shavings. It prevents undesired accumulation in the surrounding area during sharpening.

To promote efficient production, it is known to manufacture the cover housing, which comprises a floor piece and a detachably-secured hood, as a separate component and to secure a separately-manufactured sharpener to the floor of the cover housing as a conventional, inexpensive practice in mass production. This sharpener typically includes only a sharpener housing, which comprises plastic or metal, e.g., aluminum, and surrounds a guide channel having a conical tip end, as well as a cutting blade that is screwed to the sharpener housing, or extrusion-coated in one piece with the housing with the use of the sharpener-housing material. The sharpener is a commonplace, mass-produced item. Container sharpeners having a separate cover housing comprising a floor part and hood and a pencil or core sharpener secured therein are known from DE 27 45 600 A1, in which case the sharpener is secured to the floor part of the cover housing through a clamp connection.

Primarily for reasons of aesthetics, cover housings for such sharpener units have a complicated design. They are often augmented with additional functional components whose technical or design-related construction is tailored to specific customer preferences, and increases the costs of producing the cover-housing parts, particularly the hood. Because customer preferences in terms of the technical and design-related construction of the sharpener can vary greatly, the piece numbers demanded by the market are too small to justify a high production outlay for the cover housing and its technical and design-related construction.

SUMMARY OF THE INVENTION

It is an object of the invention to solve this problem using technical means that lay the foundation for efficient mass production of the cover housing. This object is accomplished by at least one of the parts of the cover housing being provided with notched projections, which project into the housing, for securing the sharpener through clamping or snapping, wherein the notched projections are positioned and configured so that both a small-format sharpener due to pressure on the outside walls of its housing from the outside inward, and a large-format sharpener due to expansion pressure on the wall regions of its housing from the inside outward can be secured between the notched projections. With this solution, the notched projections can selectively be pressed inward from the outside due to pressure on the outside walls for the clamping or snap connection of a small-format sharpener, or they can be expanded outward due to expansion pressure against wall regions of the housing, to accommodate a large-format sharpener. Of course, the exertion of the expansion force stipulates that the affected wall regions be externally accessible to the notched projections.

With the invention, it is no longer necessary to produce a separate cover housing for sharpeners of different formats. If the connection of the sharpener to the cover housing is effected by clamps or snaps, it is a type of connection described in detail in Carl-Otto Bauer's "Handbuch der Verbindungstechnik [Handbook on Connection Techniques," Carl Hanser Verlag [publisher], Munich, Vienna, 1991, pp. 269 et seq. and 295 et seq. The ability of the cover housing to secure sharpeners of different formats in clamp or snap connections, and position their guide channel for the pencil or core end precisely opposite the throughgoing opening of the cover housing, forms the basis for a viable piece-number production of cover housings or their components.

Another object of the invention capitalizes on the fact that the sharpener housings of large-format sharpeners, which are usually made from injected plastic, have thin walls. According to the invention, this injection-molding technology prevents sink marks and also saves material. As a result, the outside of the housing floor of large-format sharpeners in particular is cleaved, with the side walls of the sharpener housing freely projecting downward from the floor. This gives the sharpener, which is positioned on a base, a compact design, and by nature offers the option of accessing the downward-projecting side walls of the sharpener housing through the notched projections. In this instance, the invention employs conditions in large-format, mass-produced sharpeners that therefore need not be individually adapted for their intended use inside a cover housing in accordance with the invention.

Another embodiment of the invention has notched projections forming a U-shaped clamping rib. This embodiment allows a simple, yet especially effective method of attaining a precise positioning of the respective sharpener inside the cover housing using a clamping technique.

Another embodiment of the invention relates to a particulary effective embodiment of the clamp or snap connection in the clamping of a large-format sharpener. The peripheral wall intended for securing the closing hood of the cover housing, or parts of such a peripheral wall of the floor part, together with the notched projections projecting upward from the floor part, form a clamping groove. The side walls projecting downward beyond the housing floor of a large-format sharpener can be clamped particularly effectively between the side walls of this groove. This improves the reliable positioning of the position-fixed, large-format sharpener on the bottom part of the cover housing. Consequently, during sharpening, the sharpening forces acting on the sharpener or the sharpener housing are absorbed especially well. The sharpener will not loosen inside the cover housing, even with the occurrence of heavy vibrations.

BRIEF DESCRIPTION OF THE INVENTION

The subject of the invention is explained in detail below by way of embodiments illustrated in the figures in which.

DETAILED DESCRIPTION OF THE INVENTION

Figure 1:
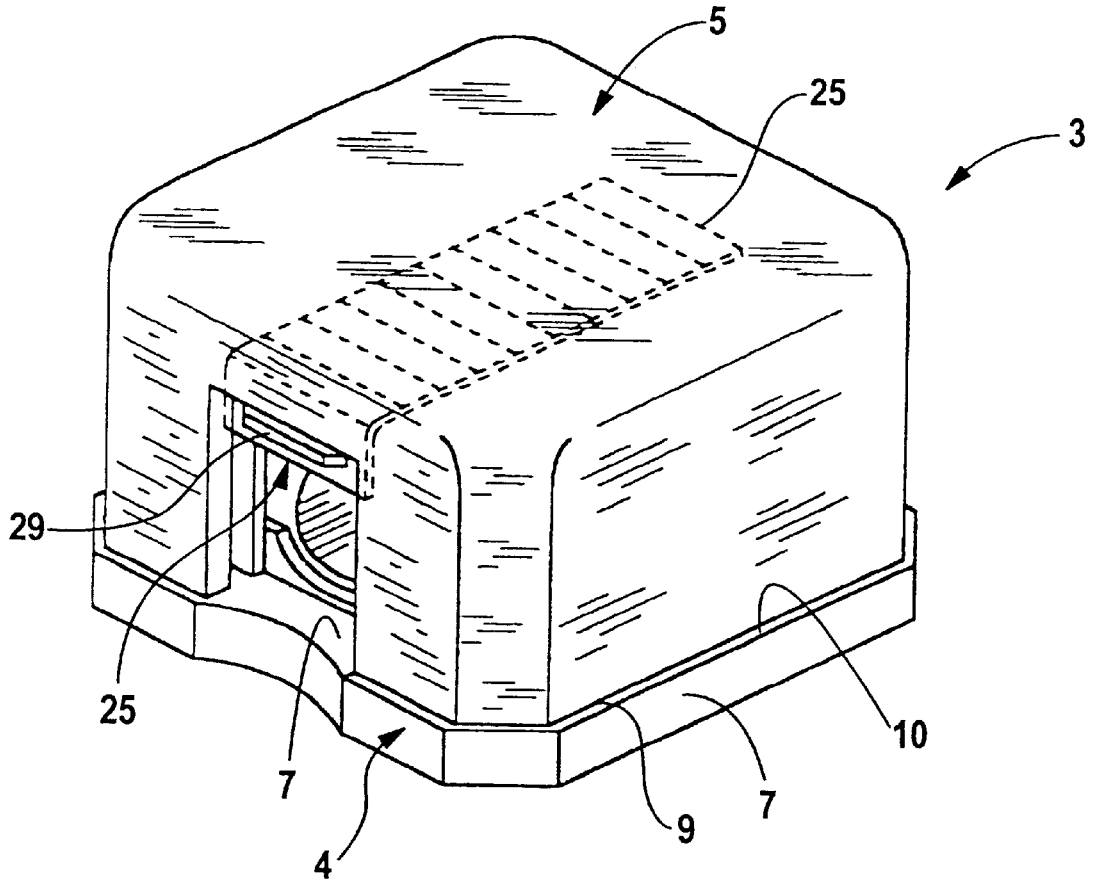
FIG. 1 is a view in perspective of an entire sharpener unit according to the invention, in the final state of assembly.
Figure 2:
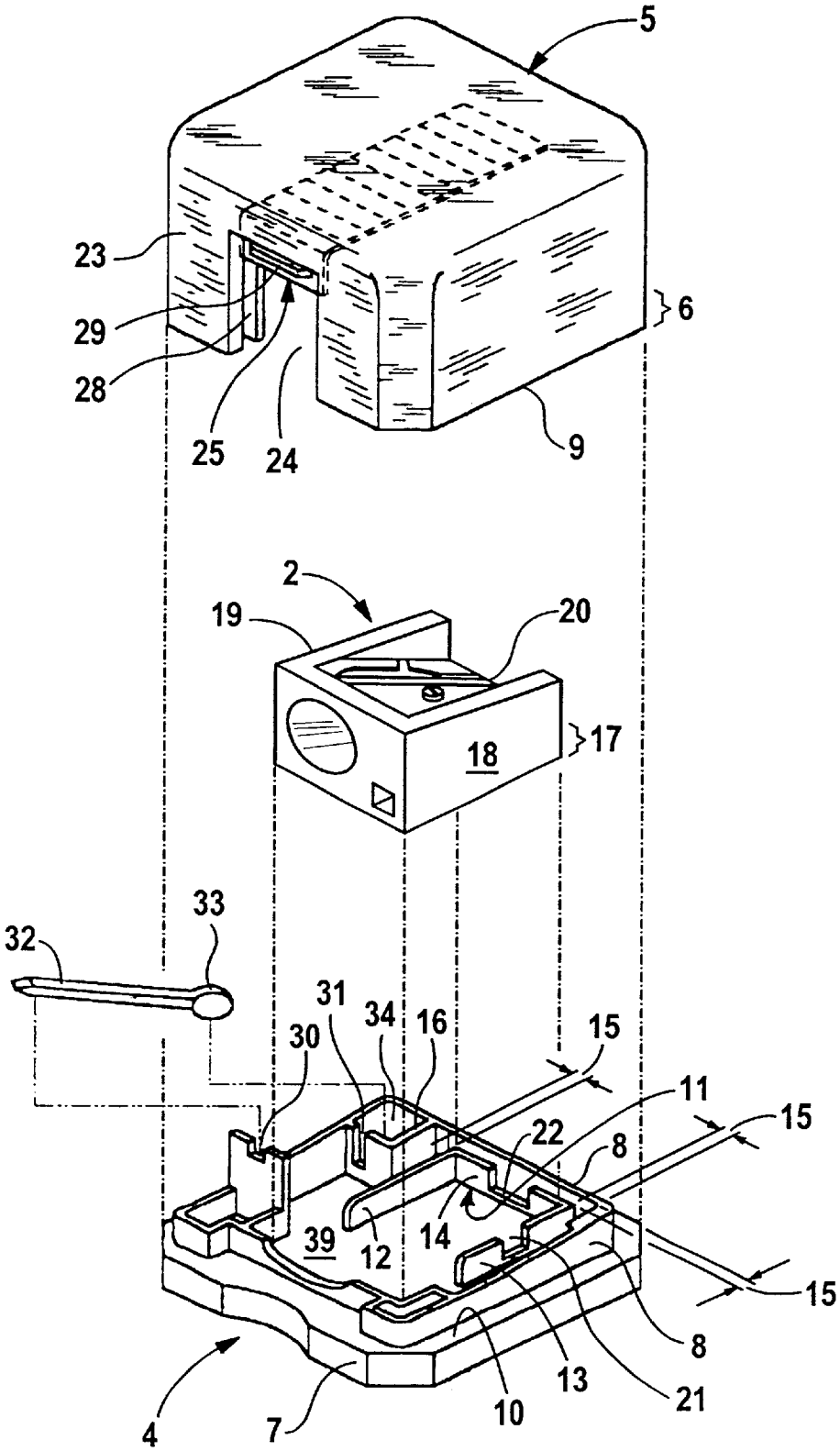
FIG. 2 shows the parts of the sharpener unit according to FIG. 1, with a small-format sharpener, in an exploded view.

The sharpener unit selectively includes a large-format pencil or core sharpener 1 or a small-format sharpener 2 and a cover housing 3, which surrounds and secures the respective sharpener 1 or 2. This cover housing 3 comprises a floor part 4 and a hood 5.

The lower edge region 6 of the hood 5 can be clamped to the floor part 4. For this purpose, the lower edge region 6 of the hood 5 is slid over the peripheral wall 8, which projects upward out of the base 7 of the floor part 4 and, in the illustrated embodiment, is closed all the way around. With respect to the peripheral wall 8, the edge region 6 of the hood 5 is dimensioned such that the hood 5 is clamped by the edge region onto the outside surface of the peripheral wall 8 in a press fit. The hood 5 is advantageously positioned precisely with its lower edge 9 on the outside surface or outside cover surface 10 of the base 7.

A U-shaped clamping rib 11 projects upward from the base 7 of the floor part 4. The U-shaped clamping rib 11 is disposed in the space that is limited by the peripheral wall 8. The free ends of the two parallel U legs 12, 13 of the clamping rib 11 project into the center of the base 7. The crosshead 14 of the U shape of the clamping rib 11 extends parallel to the adjacent part of the peripheral wall 8, thereby forming a spacing gap 15. A matching spacing gap 15 is cut out between the parallel legs 12, 13 of the U shape of the clamping rib 11 and the inside surfaces of the peripheral wall 8 or the one part of the polygonal base section 16 forming a part of the peripheral wall 8. This spacing gap 15 serves to receive the lower ends 17 of the side walls 18, 19 and the rear wall 20 of the housing of the larger sharpener 1 in a press fit. To increase the lateral elastic bending capability of the outside parallel leg 13 and the crosshead 14 of the clamping rib 11, the recesses 21, 22 are provided there. This bending can take place at a right angle to the two flanks of the crosshead 14 and the parallel legs 12, 13. In this regard, the lateral rebounding capability of the parallel legs 12, 13 and the crosshead 14 also serves to secure the smaller sharpener 2 to be in contact with the inside walls of the parallel legs 12, 13 and the crosshead 14. This is also a clamping connection.

The throughgoing opening 24 passes through the front side 23 of the hood 5. This throughgoing opening 24 is open at the height of the positioning edge 9 of the hood 5. It can be closed by a shutter 25. The shutter 25 is guided longitudinally in longitudinal guides 28 on the inside of the hood 5. At the outer end of the shutter 25, an integral, outward-projecting gripping projection 29 serves in the manual opening and closing process, and as a cover-housing stop in the open and closed positions.

Moreover, the floor part 4 is provided with receiving slots 30, 31 for a cleaning implement 32. The receiving slots 30, 31 act as clamping slots. In the fixed position, the cleaning implement 32 is also held under the hood 5 so as to be shielded from the surroundings. In the fixed end position inside a shielded opening 34, the gripping end 33 of the implement rests against the floor part 4.

Figure 3:
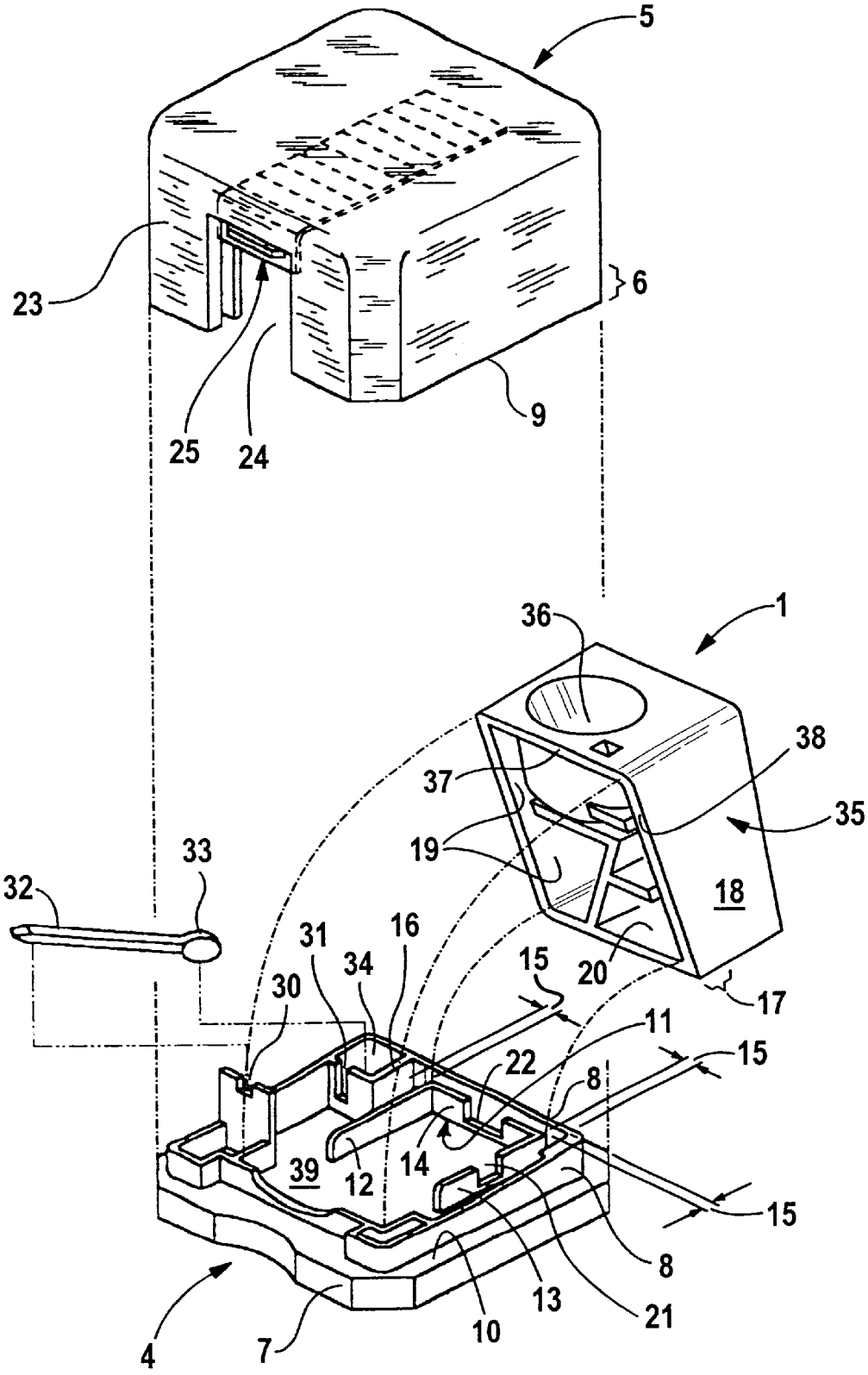
FIG. 3 shows the parts of a sharpener unit that are similar to FIG. 2, with a large-format sharpener, in an exploded view.
Figure 4:
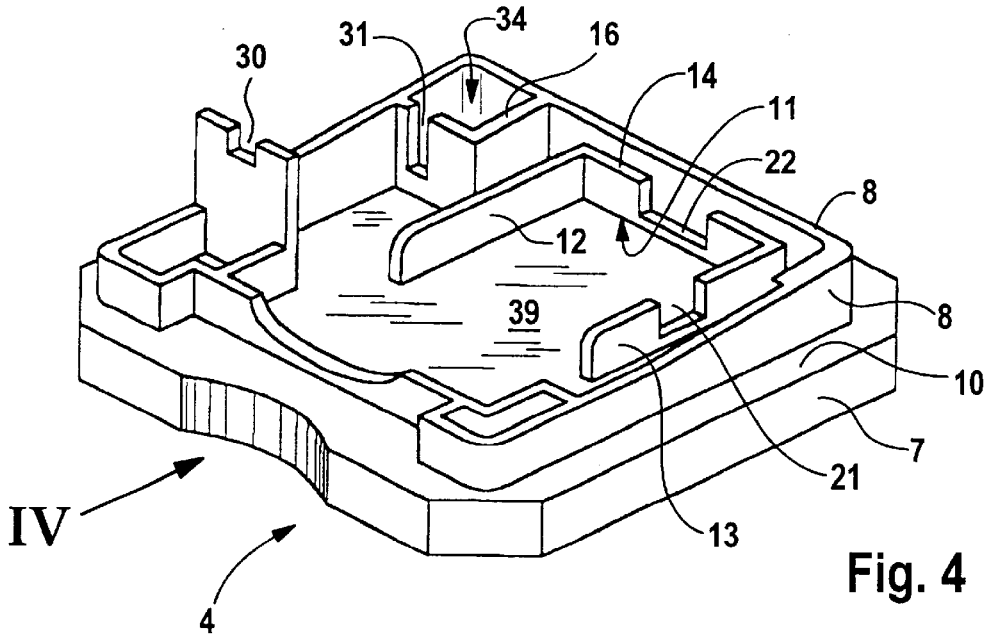
FIG. 4 shows an enlarged view in perspective of the floor part of the cover housing.
Figure 5:
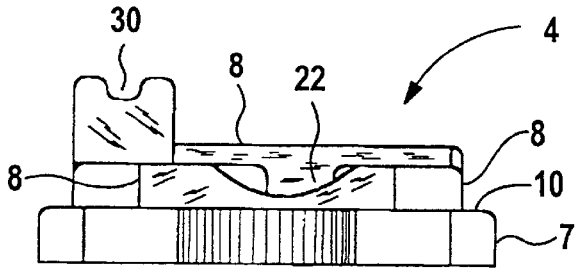
FIG. 5 is a side view of the floor part in the viewing direction of the arrow IV in FIG. 3.
Figure 6:
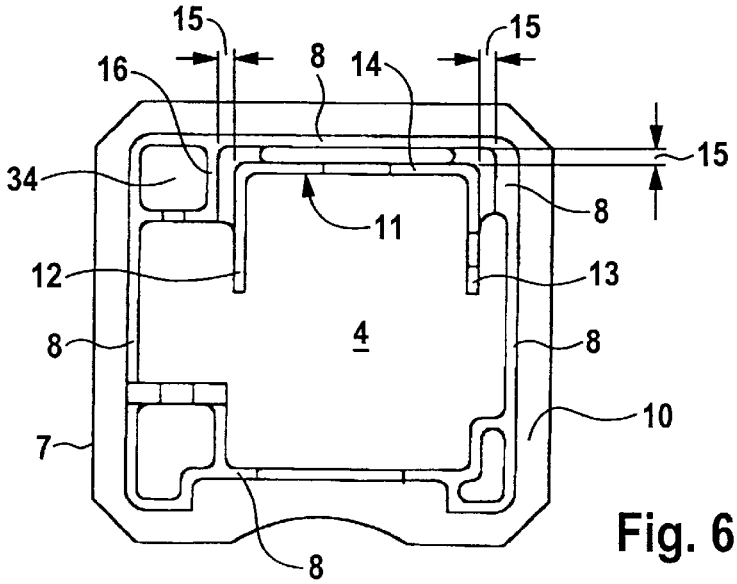
FIG. 6 is a plan view of the top side of the floor part, which faces the sharpener.

FIG. 3 clearly depicts the large-format sharpener 1 from its underside. This view illustrates the cleaved structure of the floor of the sharpener housing 35 of the large-format sharpener 1. It is a plastic injected part having thin-walled side walls 18, 19, which appear compact on the outside, and a thin-walled rear wall 20 and front wall 37, into which the opening 36 of the sharpener channel is cut. The peripheral edges 38 and these side walls form a base surface for the sharpener housing 35 on the surface 39 of the floor part 4. In the clamped or joined position, the side walls 18, 19 and the rear wall 20 of the large-format sharpener housing 1 are clamped in the spacing gap 15, which is limited between the clamping rib 11 and its parallel legs 12, 13, on the one hand, and the peripheral wall 8 and the polygonal base section 16, on the other hand. This clamping also assures reliable positioning on the floor part 4, even with the occurrence of vibrations.

What is claimed is:

1. A sharpener unit comprising:

a sharpener for sharpening a pencil or a core; and a cover housing that surrounds said sharpener and catches shavings when the pencil or core is sharpened, said cover housing including a floor part and a closing hood part detachably secured to said floor part, wherein at least one part of the cover housing forms an opening that allows access of a pencil or core to said sharpener for sharpening and has notched projections that project into the housing for securing said sharpener through clamping or snapping, and wherein the notched projections are positioned and configured to secure two different-dimensioned sharpeners.

2. The sharpener unit according to claim 1, wherein the notched projections form walls that are positioned and configured so that a small-dimensioned sharpener is clamped or snapped between the projection walls, the small-dimensioned sharpener having outside walls that are clamped or snapped between the projection walls due to inward pressure on the outside walls of the small-dimensioned sharpener from the projection walls.

3. The sharpener unit according to claim 1, wherein the notched projections form walls that are positioned and configured so that a large-dimensioned sharpener having housing walls is clamped or snapped due to expansion pressure on the housing walls by the projection walls.

4. The sharpener unit according to claim 3, wherein the notched projections project from the floor part of the cover housing, the large-dimensioned sharpener has a sharpening blade on one side, a side opposite the sharpening blade, and side walls with the sharpener being positioned with the side opposite the sharpening blade facing the floor part, the floor part has a peripheral wall which surrounds the notched projections thereby forming a spacing gap which receives lower ends of the sharpener side walls, and the peripheral wall is configured so that the side walls of the sharpener of the large-dimensioned sharpener are at least partially accessible for gripping.

5. The sharpener unit according to claim 1, wherein the notched projections form a U-shaped clamping rib with a crosshead and two flank legs, the U-shaped rib either extends around the housing of a small-dimensioned sharpener with the inside of the flank legs in contact with the small-dimensioned housing, or is positioned with the outside of the flank legs against side walls of the housing of a large-dimensioned sharpener, and the crosshead of the U-shaped clamping rib serves as a positioning stop for a sharpener.

6. The sharpener unit according to claim 5, wherein the floor part has peripheral wall portions which project from a surface of the floor part and surround the notched projections thereby forming a spacing gap which receives lower ends of the large-dimensioned sharpener side walls, the peripheral wall portions at least partially acting from the inside on at least two oppositely-located side walls of the closing hood part in the closed position to expand and clamp the side walls, and wherein at least one of a leg flank and a crosshead of the U-shaped clamping rib extends parallel to a peripheral wall portion and at least one leg flank and crosshead form between themselves a clamping groove for clamping at least one side wall of the large-dimensioned sharpener, the peripheral wall portion projecting beyond a floor of the sharpener housing.

7. The sharpener unit according to claim 1, wherein said sharpener is a manual, hand-held sharpener.

8. A sharpener container for surrounding a sharpener and catching shavings when a pencil or core is sharpened, said sharpener container comprising:

a floor part; and a closing hood part detachably secured to said floor part, wherein at least one of the floor part and the closing hood part forms an opening that allows access of a pencil or core to a sharpener secured inside the container and has notched projections that project into the container for securing the sharpener through clamping or snapping, and wherein the notched projections are positioned and configured to secure two different-dimensioned sharpeners.

9. The sharpener container according to claim 8, wherein the notched projections form walls that are positioned and configured so that a small-dimensioned sharpener is clamped or snapped between the projection walls, the small-dimensioned sharpener having outside walls that are clamped or snapped between the projection walls due to inward pressure on the outside walls of the small-dimensioned sharpener from the projection walls.

10. The sharpener container according to claim 8, wherein the notched projections form walls that are positioned and configured so that a large-dimensioned sharpener having housing walls is clamped or snapped due to expansion pressure on the housing walls by the projection walls.

11. The sharpener container according to claim 8, wherein the notched projections form a U-shaped clamping rib with a crosshead and two flank legs, the U-shaped rib either extends around a housing of a small-dimensioned sharpener with the inside of the flank legs in contact with the small-dimensioned housing, or is positioned with the outside of the flank legs against side walls of a housing of a large-dimensioned sharpener, and the crosshead of the U-shaped clamping rib serves as a positioning stop for a sharpener.

12. The sharpener container according to claim 10, wherein the floor part has peripheral wall portions which project from a surface of the floor part and surround the notched projections thereby forming a spacing gap which receives lower ends of the large-dimensioned sharpener side walls, the peripheral wall portions at least partially acting from the inside on at least two oppositely-located side walls of the closing hood part in the closed position to expand and clamp the large-dimensioned sharpener side walls, and wherein at least one of a leg flank and a crosshead of the U-shaped clamping rib extends parallel to a peripheral wall portion and at least one leg flank and crosshead form between themselves a clamping groove for clamping at least one side wall of the large-dimensioned sharpener, the peripheral wall portion projecting beyond a floor of the sharpener housing.

13. The sharpener container according to claim 11, wherein the peripheral wall portions form a closed wall around the floor part.

14. The sharpener container according to claim 11, wherein the projection wall portions secure the large-dimensioned sharpener against movement as the sharpening forces are absorbed by the container.

* * * * *